United States Patent [19]

Bennett et al.

[11] 4,407,094

[45] Oct. 4, 1983

[54] APPARATUS FOR AUTOMATIC LAPPING CONTROL

[75] Inventors: Emeric S. Bennett, Chardon; Franz L. Sauerland, Shaker Heights, both of Ohio

[73] Assignee: Transat Corp., Shaker Heights, Ohio

[21] Appl. No.: 317,778

[22] Filed: Nov. 3, 1981

[51] Int. Cl.[3] ..... B24B 49/04

[52] U.S. Cl. ..... 51/165 R; 51/118; 318/478

[58] Field of Search ..... 318/450, 453, 454, 478; 51/165 R, 118

[56] References Cited

U.S. PATENT DOCUMENTS 2,499,635 3/1950 Ferguson ..... 318/478
4,197,676 4/1980 Sauerland ..... 51/165 R
4,199,902 4/1980 Sauerland ..... 51/165 R

*Primary Examiner*—Harold D. Whitehead
*Attorney, Agent, or Firm*—Fay & Sharpe

[57] ABSTRACT

Apparatus for automatic lapping control, based on imbedding an electrode in a lap plate of a lap machine and including at least one piezoelectric wafer in the lap load. Connected with the electrode is an automatic control circuit used for sensing the resonance frequency of the piezoelectric wafer and for terminating lapping when the resonance frequency reaches a presetable target frequency. Also connected with the electrode is an impedance comparator circuit used for sensing the presence and absence of a piezoelectric wafer at the electrode face and for activating the automatic control circuit in the presence of a wafer and deactivating the control circuit in the absence of a wafer.

8 Claims, 4 Drawing Figures

APPARATUS FOR AUTOMATIC LAPPING CONTROL

BACKGROUND OF THE INVENTION

The invention relates to apparatus for control of machining parts to close dimensional tolerance. More specifically it relates to apparatus for reliable and accurate automatic grinding and lapping control and to improvements of prior art lapping control apparatus. One major application is the lapping and polishing of piezoelectric materials such as ceramic or quartz crystal wafers intended for frequency control applications and requiring precise thickness control. Another application is grinding, lapping, and polishing of nonpiezoelectric materials.

There are various types of conventional machines used for lapping wafers. Two examples are the planetary lap and the excentric or pin lap. In both machines the wafers are positioned between two lapping plates and moved with respect to the latter by means of so-called carriers. These are made of sheets of material thinner than the wafers and contain cutouts for the wafers. A lapping slurry, usually consisting of a water or oil based suspension of grinding powder, such as carborundum or aluminum oxide, is fed between the lapping plates and serves to grind and flush away the wafer particles. For polishing, a finer powder is used, and the plates may be covered by a buffeting surface. In another type of lapping machine, the wafers are again located between two plates but fixed in position—for example by waxing—to the surface of one plate. The two plates are moved relative to each other, and a slurry is fed between them. The wafers are lapped one side at a time.

The planetary lapping machine is explained in more detail below in conjunction with the description of the invention.

The main prior art methods for controlling the lapping process are described below and referred to as Methods 1 through 6.

Method 1 is based on an empirical relationship between lapping speed and lapping time. Lapping is terminated after a specified time at a constant speed.

Method 2 is based on monitoring the wafer thickness by means of measuring the distance between the lapping plates. This distance can be related to the width of an air gap between two surfaces that are referenced to the two respective lapping surfaces. The gap can be measured by various means such as air gauges or capacitive measurements.

Method 3 is based on mechanical stops that serve to limit the thickness of the lapping load from decreasing below a preset value. One approach is to use spacers between the lapping plates made from hard material such as diamond. Another approach uses the carriers as the spacers.

Methods 1, 2, 3 are simple but relatively inaccurate. In Method 1 the accuracy can be improved by repeated unloading, measuring, re-loading and relapping of the wafers. In Methods 2 and 3 the thickness is controllable to a tolerance of about ±0.005 mm, which is insufficient for precision applications such as the lapping of thin quartz wafers. An advantage of Methods 1, 2 and 3 is that they can be easily automated.

Methods 4, 5 and 6 are used for lapping wafers consisting of piezoelectric material. They are based on the piezoelectric effect which causes a piezoelectric wafer to vibrate mechanically when exposed to an A. C. signal, and to emit an A.C. signal when exposed to mechanical vibrations. In a lapping machine the mechanical vibrations are exerted on the wafer by the grinding action of slurry and lapping plates, and the corresponding A.C. signals appear between the lapping plates. The frequency of these signals corresponds to the resonance frequencies of the wafers and is therefore related to their dimensions. For example, in flat AT cut quartz wafers the resonance frequency is related to the thickness by approximately $$f = 1.66 \times 10^6 / T \quad (1)$$

where f is measured in Hz and T is the wafer thickness in mm. Hence during lapping the wafer frequency increases inversely proportional to T. For example, at a frequency of 32.2 MHz, the wafer thickness is 0.05 mm according to (1). Desired thickness control is on the order of ±0.1%, which for the above example corresponds to a thickness tolerance of ±0.00005 mm.

In Method 4 a radio receiver or similar frequency selective sensor is connected to the lapping plates to monitor the signals emitted by the wafers as they are being lapped. Normally the resonance frequencies of the individual wafers are different from each other and extend over a frequency "spread" between the lowest and highest wafer frequencies. The signals can be indicated audibly by the receiver's loud-speaker as a spectrum of increased noise as the receiver is tuned through the spread. An operator can monitor the signals and turn off the lapping machine when the spread reaches a predetermined relation to a target frequency. The main limitation of this method is due to the fact that the signals are very weak, are shunted by the large capacitance between the lapping plates, and become progressively buried in electrical noise toward higher frequencies such that the upper practical frequency limits are about 15 MHz in planetary laps and 25 MHz in pin laps. The electrical noise originates from sources external and internal to the lapping machine. The lapping plate acts on an antenna for external signals such as radio transmissions and signals caused by neighboring electrical lines or apparatus. A major source for internal noise are metallic carriers, which are used in most planetary laps. The noise is due to electrical short circuits between the lapping plates by means of the carriers. At higher wafer frequencies these carriers are quite thin and will warp or buckle between the plates because of the lateral stresses exerted on them during lapping. This causes short circuits between the plates which are usually intermittent because of the randomly isolating effect of the slurry granules.

Automatic lapping control based on Method 4 is available but suffers from the described noise problem and is therefore rarely used at frequencies above a few MHz.

Method 5 is based on the injection of an electrical signal into at least one electrically conductive electrode imbedded in at least one of the lapping plates. If the frequency of the injected signal equals the resonance frequency of a wafer passing under an electrode, the impedance under the electrode shows a characteristic change which can be displayed by instrumentation such as an oscilloscope to indicate the occurrence of wafer resonance. An operator can monitor the wafer frequencies and terminate lapping when a wafer frequency reaches a target frequency.

Since the electrode is conductive, it needs to be recessed from the lapping surface in order to avoid short circuits between electrode and lap plates due to the above mentioned carrier buckling. This recess must be large enough to allow for lap plate wear. It represents a small capacitance $C_{ser}$ in series with the electrode. In addition, there is a capacitance $C_{sh}$ shunting the signal path from the electrode to the grounded lap plates. The two capacitances $C_{ser}$ and $C_{sh}$ cause reduction of the signal/noise ratio to such a degree that it is difficult for automatic circuitry to distinguish between signal and noise. As a result, Method 5 is unsuitable for reliable automatic lapping control, especially toward higher frequencies.

In Method 6, the capacitance $C_{ser}$ is greatly increased by filling the recess with a dielectric material having a high dielectric constant. The shunt capacitance $C_{sh}$ is reduced by choosing for the electrode an insulator of low dielectric constant and suitable geometry. This results in a high signal/noise ratio. The method is described in U.S. Pat. Nos. 4,197,676 and 4,199,902, issued in April 1980 to F. L. Sauerland, and has become the predominant commercial approach to automatically controlled lapping and polishing of quartz crystal resonators. However, in extending the range of applications with regard to frequency range, types of slurries, and types of materials to be lapped, it was found that there is room for improvement in the following areas:

1. Improved signal/noise ratio for low frequency quartz resonators, especially when lapped in water slurry;
2. Reduced frequency error for lapping piezoelectric materials that have a high dielectric constant, such as ceramics;
3. Simplified and less restricted electrode design.

SUMMARY OF THE INVENTION

In accordance with the present invention, there is provided a control apparatus for a machine for precision machining. The machine has at least one reference surface, one machining surface, and at least one piezoelectric wafer between said surfaces. At least one electrode is adapted to be inserted in and isolated from at least one of said surfaces. Connectable with the electrode is an automatic control circuit used for sensing the resonance frequency of the piezoelectric wafer and for terminating machining when the resonance frequency reaches a target frequency. Also connected with the electrode is an impedance comparator circuit used for sensing the presence and absence of a piezoelectric wafer at the electrode face and for activating the automatic control circuit in the presence of a wafer and deactivating the control circuit in the absence of a wafer.

The apparatus according to the invention offers several advantages over prior art, among them increased signal/noise ratio, reduced frequency error, and simplified electrode design.

BRIEF DESCRIPTION OF THE DRAWINGS

For a better understanding of the invention, reference is made to the following description taken in connection with the accompanying drawings, and its scope is pointed out in the appended claims.

DESCRIPTION OF PREFERRED EMBODIMENTS

Figure 1:
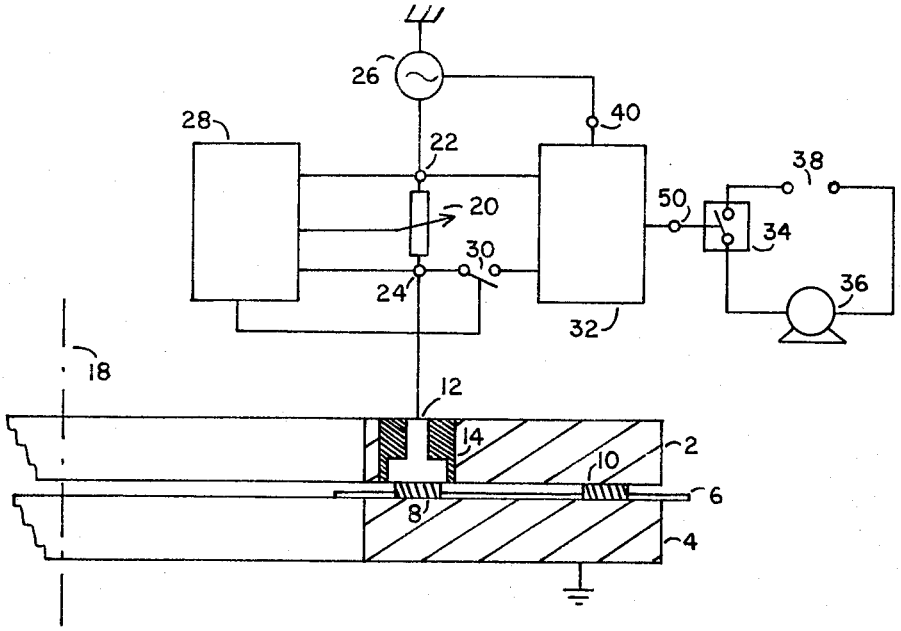
FIG. 1 shows: a partial and simplified vertical cross section of a planetary lap machine with an insulated electrode in the upper lap plate; a lap machine motor, connected to a power line via a relay; a block diagram of electric circuitry, including an impedance comparator used for sensing and reacting to the presence and absence of a wafer at the electrode face, and an automatic control circuit used for sensing wafer frequencies and for controlling the lap motor relay.

FIG. 1 shows the simplified diagram of an implementation of the present invention. The figure includes a partial and simplified vertical cross section of a planetary lapping machine with an upper lapping plate 2, a lower lapping plate 4, a carrier 6, two piezoelectric wafers 8 and 10, an electrode 12, an insulator 14, and a lapping plate center axis 18. The lower lapping plate is connected to ground. Not shown is the lapping slurry, which fills the gap between the lapping plates. Included in FIG. 1 is a voltage controllable impedance 20, such as a pin diode, with terminals 22 and 24 that are connected to electrode 12 and to a sweep frequency generator 26. Also connected to terminals 22 and 24 is an impedance comparator 28 used to sense the presence or absence of a piezoelectric wafer under the electrode and to actuate a switch 30 to connect or disconnect an automatic control circuit 32 that serves to sense wafer frequencies and to control a relay 34 used for switching between a lapping machine motor 36 and an electric power supply at terminals 38.

Figure 2:
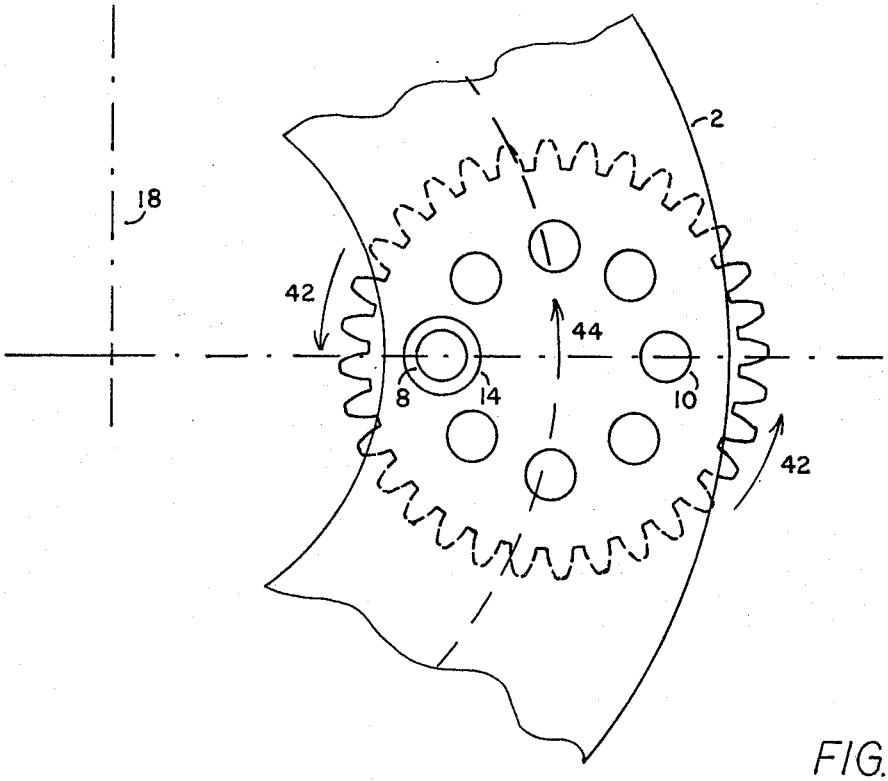
FIG. 2 is a partial top view corresponding to the cross section of the planetary lap machine of FIG. 1.

FIG. 2 represents a partial top view corresponding to the lap cross section of FIG. 1. It shows part of the upper lapping plate 2, center axis 18, carrier 6, wafers 8 and 10, and six more unmarked wafers. The carrier teeth engage in gears which are not shown and are concentrically arranged along the outer and inner periphery of the lapping plates, driving the carriers as indicated by arrows 42 and 44 in planetary movement around their own axis and around axis 18, respectively.

For the following, these definitions are made:

The terms piezoelectric wafer and piezoelectric resonator will be used interchangeably. The times of presence or absence of a piezoelectric wafer at the electrode face will be called ON time and OFF time, respectively. The impedance across the gap between the electrode and the opposite lap plate will be called gap impedance. During ON time, the gap is filled by a wafer as shown in FIG. 1. During OFF time, the gap is filled by slurry or by slurry plus carrier.

The arrangement of FIG. 1 functions as follows:

Sweep frequency generator 26 applies a signal across the series connection of impedance 20, electrode 12, and the gap impedance. Impedance monitor 28 serves to monitor the gap impedance and to close or open switch 30 during ON or OFF time, respectively. By this action, automatic control circuit 32 is activated during ON time and deactivated during OFF time. During ON time, it monitors the resonance frequency of the wafer, compares it to a presetable target frequency, and opens relay 34 when the wafer frequency equals or exceeds the target frequency. At this instance, the power to lap machine motor 34 is interrupted and the lapping is terminated.

The apparatus offers advantages such as:

1. Increased signal/noise ratio. Since the automatic control circuit is inactive during OFF time—which is most of the time—most of the noise has no effect on the circuit. Also, the noise amplitude during OFF time can be and has been observed to be larger during OFF time than during ON time. This is due in part to the wide range of gap impedances and the difficulty of matching to them for optimum signal/noise ratio. For example, in water slurry, which has a high dielectric constant, the gap impedance during OFF time can approach an A.C. short circuit.

2. Decreased frequency error. The series capacitance $C_{ser}$ mentioned in conjunction with Methods 5 and 6 causes a measurement error for the wafer frequency of $$\Delta f \simeq fC/2(C_{ser}+C_o)$$

where f, C and $C_o$ are, respectively, the resonance frequency, motional capacitance, and shunt capacitance of the piezoelectric wafer. The error is negligible if $C_{ser}$ is large compared to C and $C_o$. This is true for Method 6 as applied to quartz wafers. It is not true for ceramic wafers where $C_o$ may be of the same order of magnitude as $C_{ser}$, and $C/C_o$ on the order of 0.1. This can result in a frequency error of several percent.

3. Simpler and less restricted electrode design. Since the automatic control circuit is only active during ON time, the electrode no longer needs the special dielectric facing used in Method 6 and can be made of conducting material. For example, the electrode can be made from the same material as the lap plate in order to match its hardness and wear.

Figure 3:
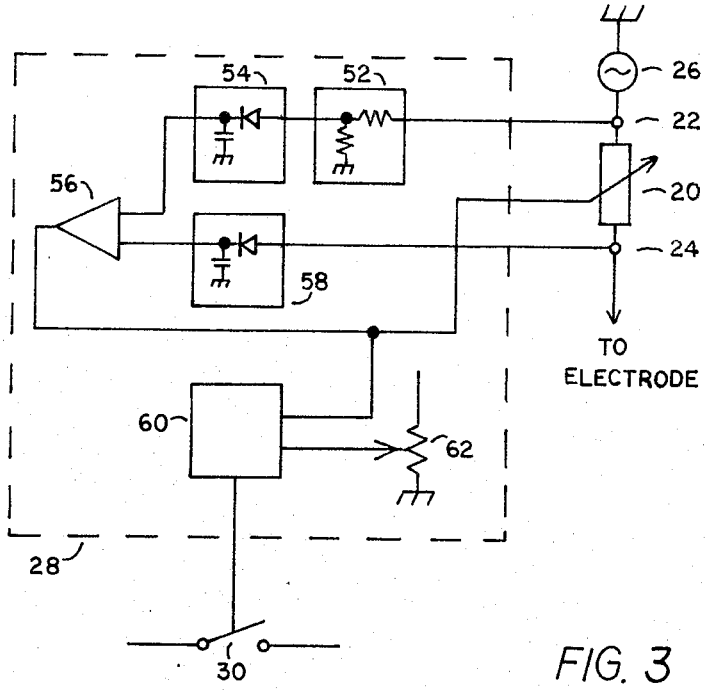
FIG. 3 is a block diagram of circuitry comprised by the impedance comparator of FIG. 1.

FIG. 3 is a block diagram of the impedance comparator of FIG. 1. The voltage at terminal 22 is applied to a 2:1 voltage divider 52 whose output is connected to one input of a differential amplifier 56 via an envelope detector 54. The voltage at terminal 24 is applied to the other input of differential amplifier 56 via an envelope detector 58. The output of 56 is connected to voltage controllable impedance 20 in such a manner as to adjust it until the two input voltages of 56 are of approximately equal amplitude. Since amplifier 56 has close to infinite gain, this corresponds to impedance 20 being approximately equal in amplitude to the gap impedance—to be called Z—between electrode and ground.

With the described arrangement the output voltage of 56 adjusts to the value required to equalize impedance 20 to $|Z|$. This voltage is also applied to one input of a voltage comparator 60. The other input of 60 is applied to a variable resistor 62 which serves for setting a reference impedance threshold. The output of comparator 60 is connected to open switch 30 when $|Z|$ drops below the preset impedance threshold for a time longer than a time T, where T is the time it takes the sweep generator to sweep through the resonance response of a wafer. This time requirement is necessary to prevent the impedance comparator from reacting to the impedance change that occurs during the sweep through the resonance response. Furthermore, for the comparator to detect presence and absence of a wafer, both the ON time and OFF time must be long compared to T.

To illustrate the functioning of impedance comparator 28, consider the example of lapping quartz wafers in water slurry. Since water has a dielectric constant approximately 20 times higher than that of quartz, the gap impedance may vary from the relatively high impedance of a wafer to that of water, to that of water plus slurry.

Suppose the impedance threshold is set for voltage comparator 60 to close switch 30 for impedances larger than Z/4, and to open switch 30 for all impedances smaller than that. Then automatic control circuit 32 is then activated during ON time and inactivated during OFF time.

Figure 4:
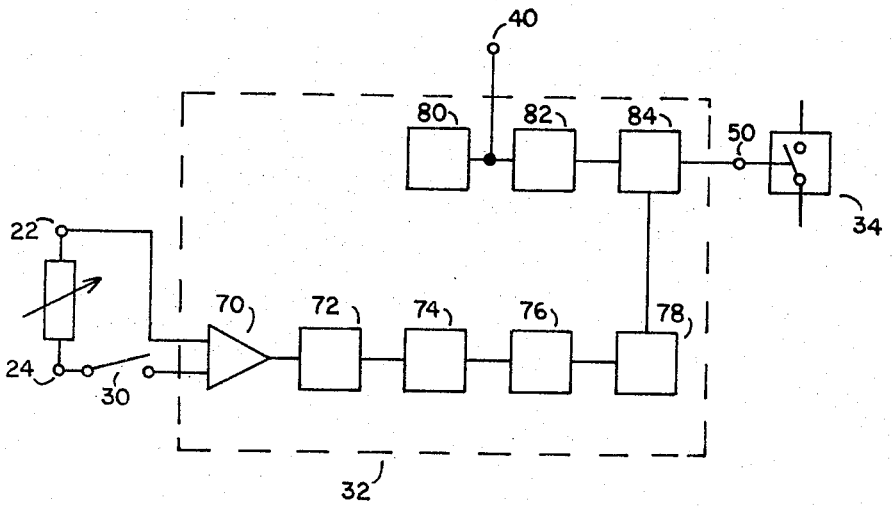
FIG. 4 is a block diagram of circuitry comprised by the automatic control circuit of FIG. 1.

FIG. 4 is a block diagram of automatic control circuit 32, which is analogous to a circuit described in the previously referenced U.S. Pat. No. 4,197,676. The circuit comprises: a differential amplifier 70 whose input terminals are connected to terminals 86 and 87 and whose output is applied to a cascade connection of an r.f. detector 72, filter 74, level shifter 76 and peak detector 78; a sweep voltage generator 80 whose output is applied to terminal 88 and to a squaring circuit 82; a coincidence detector 84 whose two inputs are connected to the outputs of peak detector 78 and squaring circuit 82 and whose output is applied to terminal 90.

The circuit can operate as follows: The sweep generator 80 has a triangular output wave form symmetric to a reference voltage level $V_r$. The sweep voltage is converted by circuit 82 into a square wave whose crossings of the $V_r$ level are coincident with those of the sweep voltage crossings. The reference voltage $V_r$ is adjusted such that the corresponding frequency of the Voltage Controlled Oscillator 60 of FIG. 4 equals a desired target frequency. The frequency of the Voltage Controlled Oscillator is then swept about this target frequency. When a wafer resonance frequency falls within the swept frequency range, the corresponding impedance change under the electrode causes a voltage change across resistor 62 which is amplified, detected and filtered in blocks 70, 72 and 74. The signal at the output of filter 74 shows a strong amplitude change with a maximum at the wafer resonance. To separate this response from any undesired noise, the signal is applied to level shifter 76 which shifts the reference level above the noise level. The output of level shifter 76 is applied to peak detector 78, which detects the exact location of the maximum or peak of a change in its input voltage and provides an output voltage coincident with the input voltage peak, which as explained before occurs at the wafer resonance frequency. The coincidence detector 84 serves to monitor the outputs of peak detector 78 and squaring circuit 82 and is adjusted such that it produces an output signal that turns off solid state relay 66 only when peaks coincide with sweep voltages equal to or larger than the reference voltage $V_r$. This means that lapping is terminated as soon as an observed wafer frequency reaches or exceeds the target frequency.

The application of the invention is not restricted to lapping of planparallel wafers but can also be used for lapping bevelled, lens-shaped piezoelectric resonators. Further, the invention can also be applied to lapping, polishing and precision machining of nonpiezoelectric materials, provided there is at least one piezoelectric monitor. For an example, the eight cutouts in the planetary lap carrier 2 of FIG. 2 can be filled with nonpiezoelectric wafers. These wafers can be machined to accurate thickness dimension by means of apparatus according to the present invention if these changes are made: an additional cutout is made in the center of carrier 2; this cutout is filled with a piezoelectric monitor wafer; the electrode is repositioned in the lap plate such that it faces the monitor once per revolution of the carrier around axis 18; the monitor frequency is measured and is related to the thickness of the nonpiezoelectric wafers by equation (1) given in the background.

In the above mentioned example of lapping quartz in water slurry, the gap impedance during ON time is higher than during OFF time. The relationship may be reversed, as for instance in lapping ceramic piezoelectric wafers in oil slurry. The dielectric constant of the ceramic is generally higher than that of oil. This results in the gap impedance being lower during ON time than during OFF time. In general, for said impedance comparator to discriminate between ON and OFF times, the dielectric constants and thereby the impedances of wafer and slurry have to be sufficiently different. This may not be the case when lapping quartz in oil slurry. AT cut quartz—the type used most in high frequency quartz resonators—has a relative dielectric constant close to that of some oil slurries. In this case, the impedance comparator may constantly sense a high impedance and declare ON time all the time. If a conducting electrode were used, the system would suffer from the deficiencies of Method 5, such as short circuits between electrode and carrier, or low signal/noise ratio, or both. As explained before, these deficiencies can be cured by using an electrode according to Method 6 and U.S. Pat. No. 4,197,676, with a dielectric facing of high dielectric constant and an insulator of low dielectric constant. Hence, for apparatus according to the invention to be applicable to lapping various types of material in various types of slurry, it should be combinable with an electrode according to U.S. Pat. No. 4,197,676.

As mentioned before, the shunt capacitance $C_{sh}$ from the electrode to ground can be reduced by using an insulator of low dielectric constant and suitable geometry. Since $C_{sh}$ is inversely proportional to the insulator wall thickness between electrode and lap plate, it is desirable to make the average wall thickness large compared to the wall thickness at the lapping surface. For example, the wall thickness of insulator 14 of FIG. 1 satisfies this requirement in that it is small at the lapping surface and large farther away from the lapping surface.

Apparatus according to the invention is not restricted to use with planetary lap machines but can also be applied to other types of precision lapping and machining. In one such application the parts to be machined are fastened to a flat reference surface and face a lapping or grinding surface parallel to the reference surface. A monitor wafer—if necessary mounted on a spacer of known thickness—can be fastened to the same reference surface. An electrode can be mounted in the machining surface such that it periodically faces the monitor wafer, and the thickness of the work pieces can be evaluated from the wafer frequency and the spacer thickness.

While there have been described what are at present considered to be the preferred embodiments of this invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is:

1. Control apparatus for a machine for precision machining, having at least one reference surface, one machining surface, and at least one piezoelectric resonator between said surfaces, comprising:

a. at least one electrode able to be inserted in and insulated from one of said surfaces;

b. automatic control means for sensing the resonance frequency of said piezoelectric resonator and for terminating the machining process when said resonance frequency reaches a target frequency;

c. impedance sensing means for sensing the presence and absence of a piezoelectric resonator at the electrode face and for:

deactivating said automatic control means in the absence of a piezoelectric resonator at the electrode face, and activating said automatic control means in the presence of a piezoelectric resonator at the electrode face.

2. Apparatus according to claim 1 wherein the machine for precision machining is a lap machine having at least one lap plate with a lapping surface and at least one piezoelectric resonator, comprising at least one electrode able to be inserted in and insulated from said lap plate.

3. Apparatus according to claim 2 wherein said impedance sensing means is operatively connected with said automatic control means for terminating lapping automatically.

4. Apparatus according to claim 2 wherein said electrode is faced with a solid dielectric material with a relative dielectric constant larger than 10 and being positionable toward the lapping surface.

5. Apparatus according to claim 2 further including means for applying an electrical signal between said electrode and said lapping plate, said signal applying means operatively connected with said automatic control and impedance sensing means, whereby the resonance frequency is sensed in terms of impedance changes between said electrode and said lapping plate.

6. Apparatus according to claim 5 wherein said impedance sensing means is operatively connected with said automatic control means for terminating lapping automatically.

7. Apparatus according to claim 2 wherein said electrode is separated from said lapping plate by an insulator having a relative dielectric constant smaller than 10, a first wall thickness adjacent to the lapping surface, and at least one second wall thickness displaced from the lapping surface, said second wall thickness being larger than the first.

8. Apparatus according to claim 7 wherein said impedance sensing means is operatively connected with said terminating means for terminating lapping automatically.

* * * * *